US010772421B2

(12) United States Patent
Kampl et al.

(10) Patent No.: US 10,772,421 B2
(45) Date of Patent: Sep. 15, 2020

(54) DRAWER WALL

(71) Applicant: Julius Blum GmbH, Hoechst (AT)

(72) Inventors: Markus Kampl, Dornbirn (AT); Guenter Schwarzmann, Dornbirn (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/568,664

(22) Filed: Sep. 12, 2019

(65) Prior Publication Data

US 2020/0000226 A1 Jan. 2, 2020

Related U.S. Application Data

(63) Continuation of application No. PCT/AT2018/060060, filed on Mar. 8, 2018.

(30) Foreign Application Priority Data

Apr. 5, 2017 (AT) ..... 50272/2017

(51) Int. Cl.
*A47B 88/00* (2017.01)
*A47B 88/925* (2017.01)
(Continued)

(52) U.S. Cl.
CPC ..... *A47B 88/925* (2017.01); *A47B 88/423* (2017.01); *A47B 88/46* (2017.01)

(58) Field of Classification Search
CPC ..... A47B 88/46; A47B 88/423; A47B 88/925
(Continued)

(56) References Cited

U.S. PATENT DOCUMENTS 2,087,904 A * 7/1937 Flood ..... A47F 3/12 312/114
4,848,860 A * 7/1989 Rock ..... A47B 88/427 312/334.7
(Continued)

FOREIGN PATENT DOCUMENTS

CN 1745680 3/2006
CN 201319988 10/2009
(Continued)

OTHER PUBLICATIONS

International Search Report dated Apr. 24, 2018 in International (PCT) Application No. PCT/AT2018/060060.
(Continued)

*Primary Examiner* — Matthew W Ing
(74) *Attorney, Agent, or Firm* — Wenderoth, Lind & Ponack, L.L.P.

(57) ABSTRACT

A drawer wall includes a shell with an opening arranged on a shell surface of the drawer wall, a movably supported cover portion which covers the opening in a closed position and unblocks the opening in an open position, and a spring element by which the cover portion is pre-stressed in an operating (closing) direction of the spring element toward the closed position. The cover portion is arranged so as to be stationary in a direction parallel to the shell surface, and is movably supported in a direction approximately perpendicular to the shell surface against the operating direction of the spring element, and the cover portion is arranged within the shell of the drawer wall in all operating positions.

18 Claims, 4 Drawing Sheets

(51) Int. Cl.
*A47B 88/423* (2017.01)
*A47B 88/46* (2017.01)

(58) Field of Classification Search
USPC ..... 312/330.1
See application file for complete search history.

(56) References Cited

U.S. PATENT DOCUMENTS

| | | | | |
|---|---|---|---|---|
| 8,297,724 | B2 * | 10/2012 | Hammerle | A47B 88/956 312/265.5 |
| 9,456,690 | B2 * | 10/2016 | Feuerstein | A47B 88/941 |
| 10,117,514 | B2 | 11/2018 | Karu et al. | |
| 2006/0049730 | A1 * | 3/2006 | Sutterlutti | A47B 88/00 312/330.1 |
| 2016/0360884 | A1 | 12/2016 | Karu et al. | |

FOREIGN PATENT DOCUMENTS

| | | |
|---|---|---|
| CN | 104519770 | 4/2015 |
| DE | 20 2010 002 617 | 10/2010 |
| DE | 20 2013 011 425 | 4/2015 |
| EP | 0 035 595 | 9/1981 |
| EP | 1 632 151 | 3/2006 |
| WO | 2010/045782 | 4/2010 |
| WO | 2014/005164 | 1/2014 |

OTHER PUBLICATIONS

Search Report dated Dec. 7, 2017 in Austrian Application No. A 50272/2017, with English translation.

* cited by examiner

DRAWER WALL

BACKGROUND OF THE INVENTION

The present invention relates to a drawer wall, comprising an opening arranged on a shell surface of the drawer wall, a movably-supported cover portion which closes the opening in a closed position and unblocks the opening in an open position, and a spring element by which the cover portion is pre-stressed in an operating direction of the spring element in a direction of the closed position. The cover portion is arranged so as to be stationary in a direction parallel to the shell surface, and is movably supported in a direction approximately perpendicular to the shell surface against the operating direction of the spring element.

The invention further concerns an arrangement comprising a drawer wall of the type to be described and a wall element which is set onto the drawer wall in the mounted position.

The invention further refers to a drawer comprising at least one of such a drawer wall or an arrangement of the aforementioned type.

EP 1 632 151 A1 shows a drawer wall configured as a hollow-chamber profile having an opening arranged on a shell surface. A screwdriver can be introduced through the opening in order for holding or adjustment devices to be actuated. The opening can be closed by a movably-supported cover portion which can be pushed by a spring device into a position in which the opening is closed.

WO 2010/045782 A1, in the embodiment according to FIG. 14, shows a drawer side wall having an opening arranged on a front-end region, and the opening allows access to a locking device for releasably locking the drawer side wall to a front panel. For closing the opening, a cover portion made of a flexible material is provided. A first fastening end of the cover portion is pivotally mounted on the side wall on the one hand, and a second fastening end of the cover portion can be snapped by a protrusion into a hole of the drawer side wall. A drawback is the fact that the cover portion, in an open position, protrudes transversely from the drawer side wall in an outward direction. As a result, additional installation space has to be provided. Moreover, there is the danger that the cover portion can be sheared off or can be broken off by objects and is therefore no longer available for closing the opening.

DE 20 2010 002 617 U1 shows according to FIGS. 3-5 a drawer side wall having a recess, and an actuating lever is pivotally mounted about a vertically extending axis in the mounted position. The actuating lever is provided for locking the front panel with the aid of a force of a spring element, so that a holding force for the front panel can be provided. For locking purposes, the actuating lever needs to be moved against the force of the spring element in a position in which the recess is covered.

SUMMARY OF THE INVENTION

It is an object of the present invention to propose a more compact drawer wall of the type mentioned in the introductory part, thereby avoiding the drawbacks as discussed above.

According to the invention, an entirety of the cover portion is arranged within the shell of the drawer wall in all operating positions. This also includes the measure that the cover portion can be arranged at least partially within a wall thickness of the drawer wall.

The drawer wall includes a shell with at least one opening arranged on a shell surface, and a cover portion for closing the opening. The cover portion covers the opening in the closed position and can be moved, in a direction against the resilient action of the spring element, in a direction perpendicular to the opening plane into the interior of the drawer wall.

The opening in the shell surface can be provided, for example, to enable an introduction of a screwdriver for rotating adjustment devices of the drawer wall and/or for introducing a fastening element of a second drawer wall and/or for introducing a holding device for drawer components. The second drawer wall can be formed either by a bent metal profile portion, or, alternatively, by a decorative plate, for example made of glass, wood, plastic, stone or ceramics.

The spring element can be formed by a helical spring, for example a compression spring. Alternatively, it is also possible that the spring element is formed by a material elasticity of a plastic portion. In this connection, it can be advantageous if the cover portion, together with the spring element, has a one-piece configuration. In this way, an easy construction and an economic production can be realized.

The spring element can be arranged on a base body so as to be bendable or tiltable. The spring element can have a free end portion, and the cover portion is formed by the free end portion of the spring element. The base body can be formed in one piece by an injection molding with plastic and can be accommodated within a cavity of the drawer wall.

BRIEF DESCRIPTION OF THE DRAWINGS

Further details and advantages of the present invention result from the embodiments shown in the drawings, in which.

DETAILED DESCRIPTION OF THE INVENTION

Figure 1A:
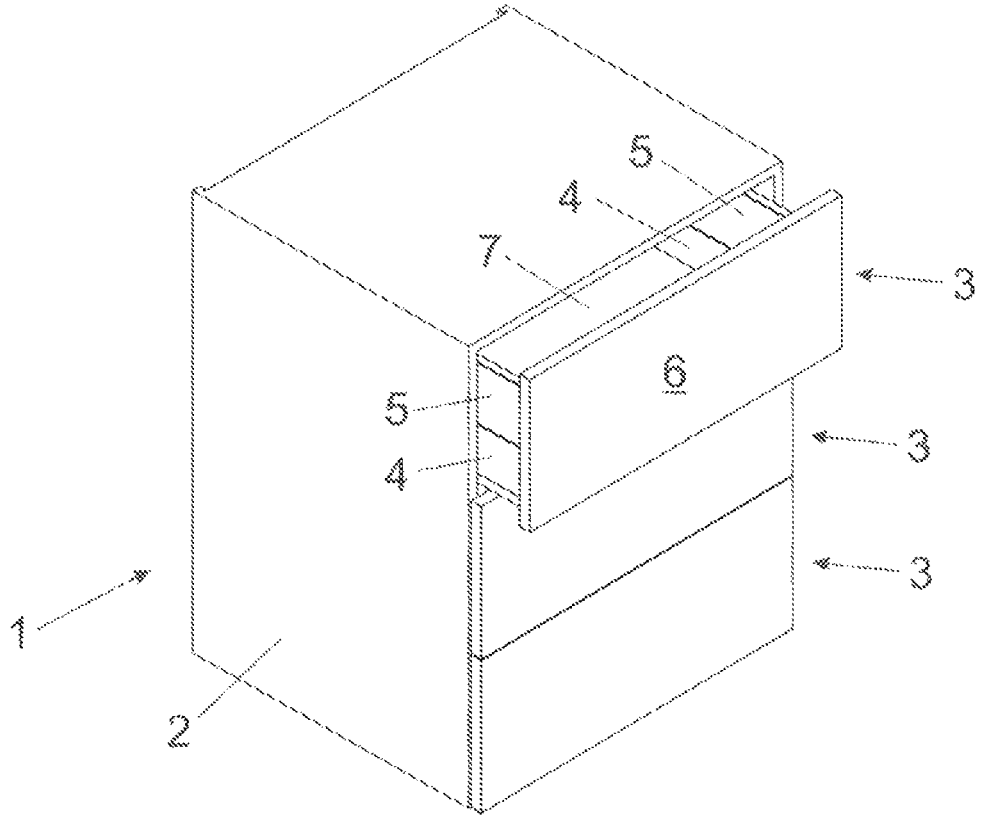
FIG. 1*a*, 1*b* are perspective views of an item of furniture with displaceable drawers, and a drawer wall with an attached wall element.

FIG. 1*a* shows a perspective view of an item of furniture 1 with drawers 3, the drawers 3 being configured to be displaceable relative to a furniture carcass 2 by drawer pull-out guides (not shown). Each of the drawers 3 has a drawer bottom 7, a drawer wall 4 and a wall element 5 set onto the drawer wall 4. Each of the drawer wall 4 and the wall element 5 are connected to a front panel 6.

Figure 1B:
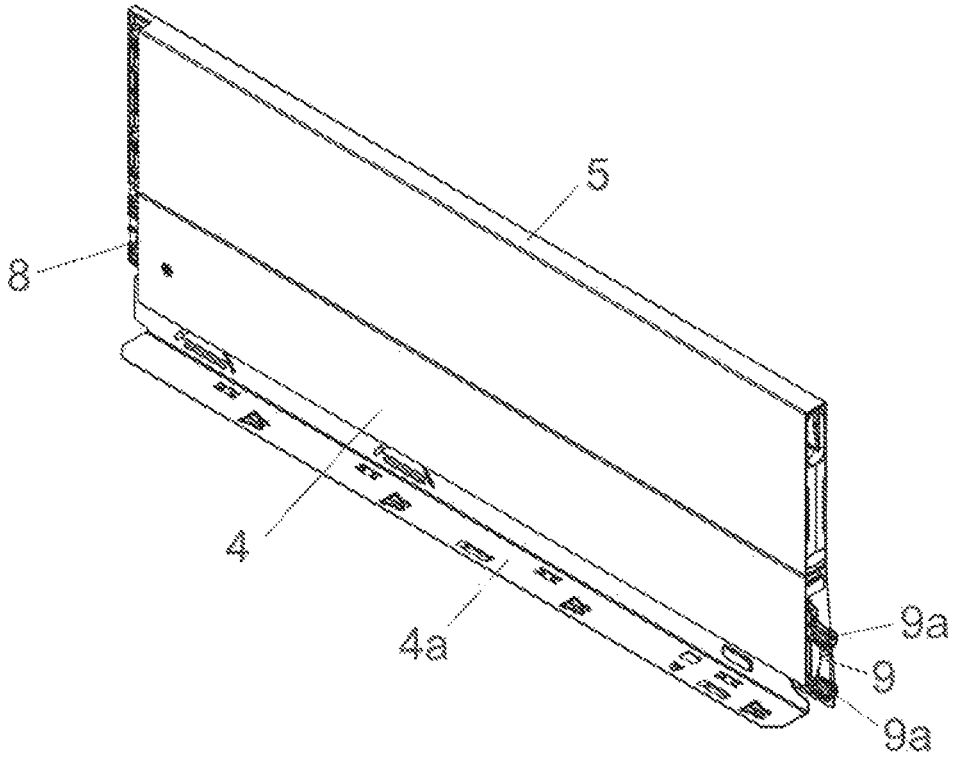

FIG. 1*b* shows the drawer wall 4 with the attached wall element 5 in a perspective view. The drawer wall 4 has a shell 13 which can be formed by a bent metal profile, preferably an extruded metallic profile or a steel sheet. A holding portion 9 is to be fixed to the front panel 6, and the holding portion 9 includes two dowels 9*a* spaced from each other in a height direction. The holding portion 9 pre-mounted to the front panel 6 is configured to be releasably locked with a locking device 16 (FIG. 4) arranged in the shell 13 of the drawer wall 4. The drawer wall 4 further includes a support limb 4*a* for supporting the drawer bottom 7, and a fastening adaptor 8 for fastening a drawer rear wall. The wall element 5 can also be formed by a bent hollow-chamber profile.

Figure 2A:
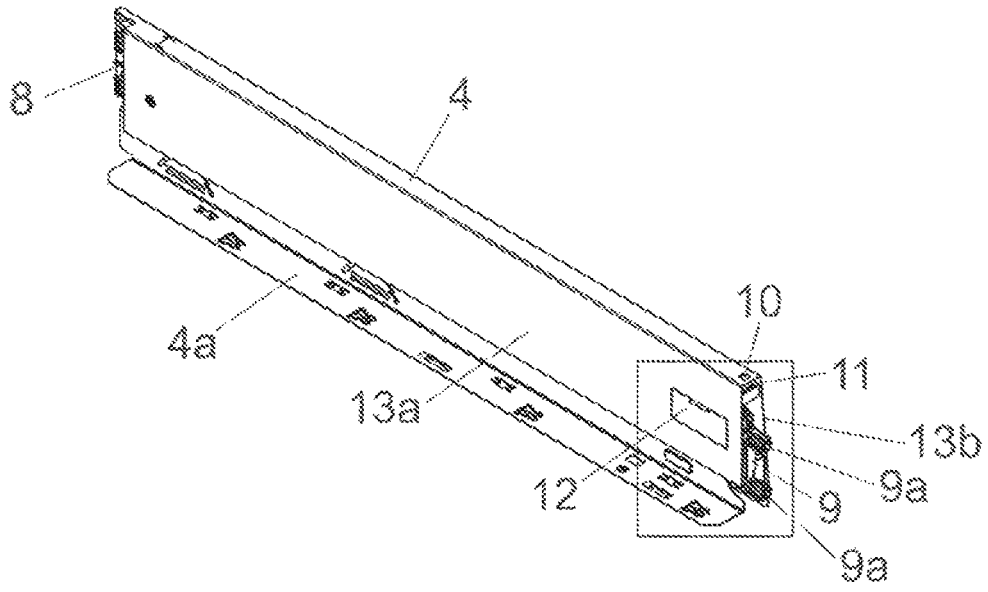
FIG. 2*a*, 2*b* show the drawer wall in a perspective view, and an enlarged detail view thereof.

FIG. 2*a* shows a perspective view of the drawer wall 4 in which the shell 13 is configured as a hollow-chamber profile, and the shell 13 with the hollow chamber profile has an inner profiled shell wall 13*a* and an outer profiled shell wall 13*b*. The inner profiled shell wall 13*a* and the outer profiled shell wall 13*b* are connected to one another by a, preferably flat-shaped, upper shell wall 13*c*. A detachable closing portion 12 is arranged on the inner profiled shell wall 13*a*, the closing portion 12 covers a recess of the profiled wall 13*a*, and the recess being provided for the passage of a tool. On a shell surface of the drawer wall 4 (thus on the inner profiled shell wall 13*a*, the outer profiled shell wall 13*b*, and/or on the upper shell wall 13*c*), an opening 10 is provided. The opening 10 can be provided for the passage of a screwdriver and/or for fastening the wall element 5 shown in FIG. 1*b* and/or for fastening a holding device for drawer components.

Figure 2B:
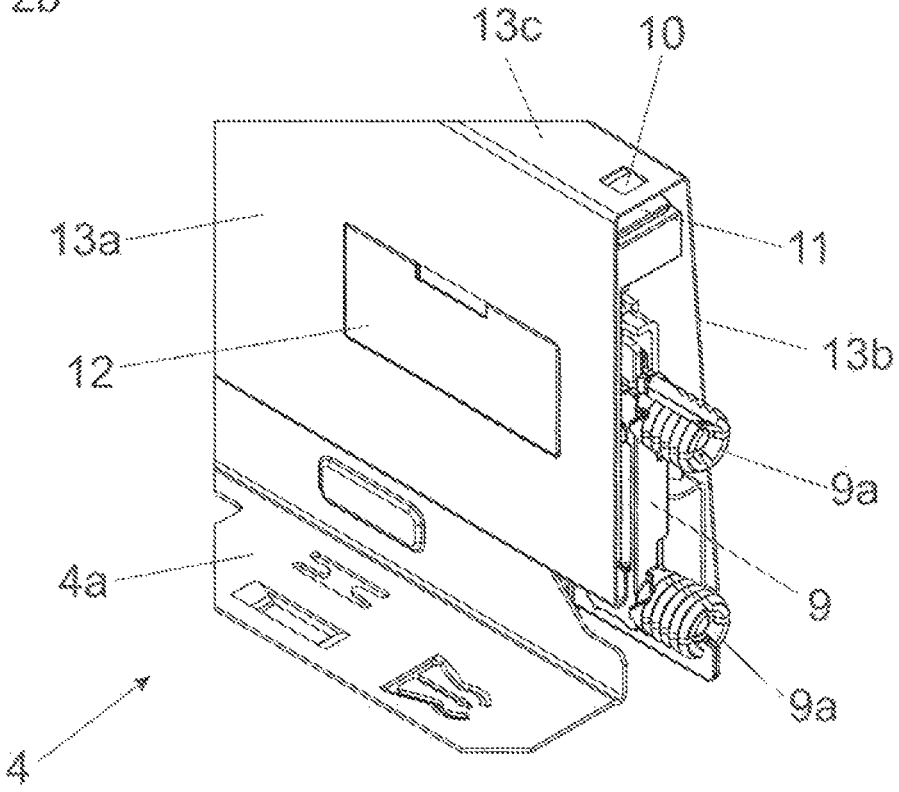
Figure 4:
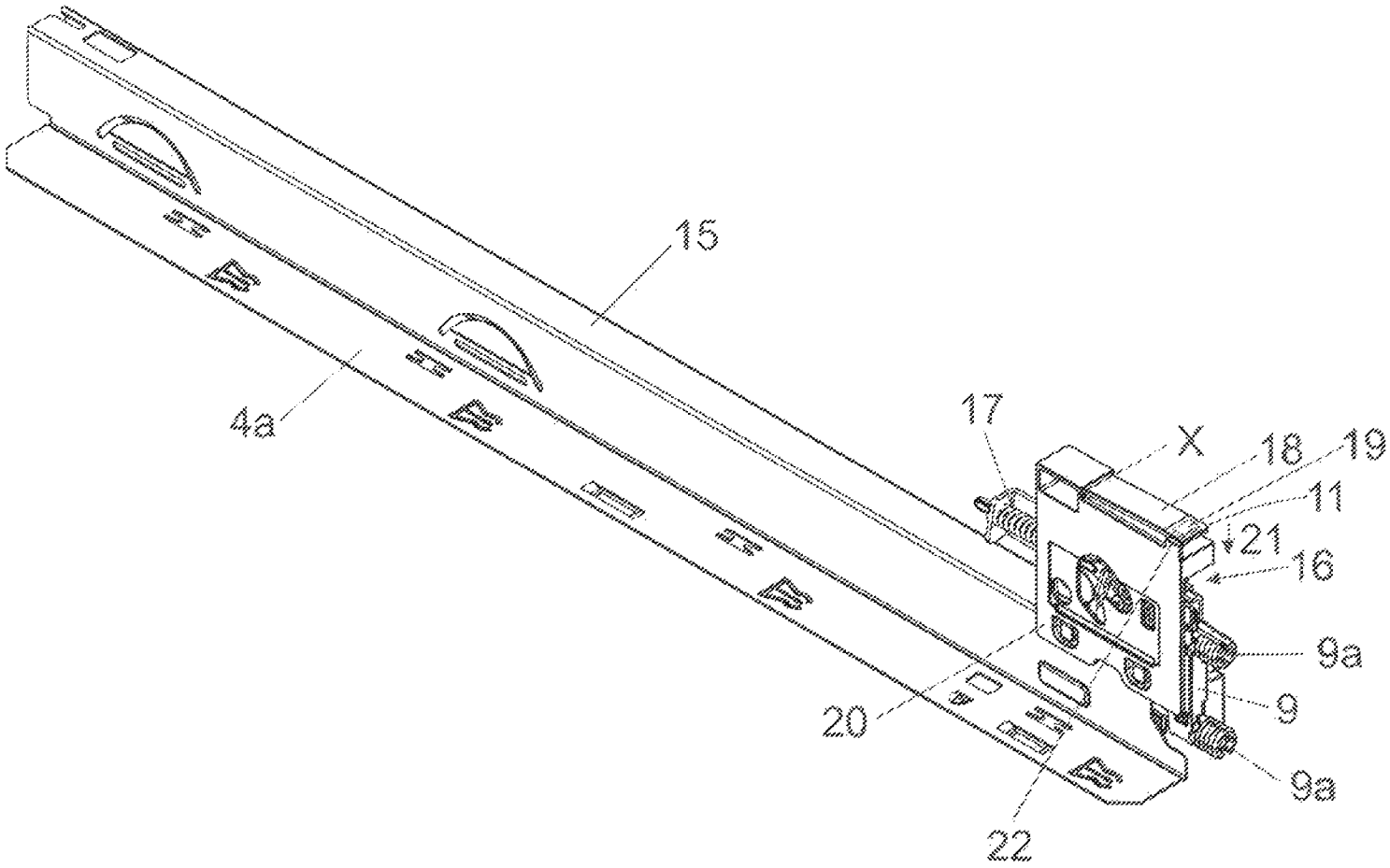
FIG. 4 shows a carrier rail of the wall element in a perspective view.

FIG. 2*b* shows the framed region of FIG. 2*a* in an enlarged view. The opening 10, which has, for example, a rectangular shape, of the drawer wall 4 is closed by a movably supported cover portion 11 when not in use. The cover portion 11 is arranged so as to be stationary in a direction parallel to the upper shell wall 13*c*, and is movably mounted in a direction approximately perpendicular to the upper shell wall 13*c* against an operating direction of a spring element 18 (FIG. 4). The entire cover portion 11, in all operating positions, is arranged within the shell 13 of the drawer wall 4. According to an embodiment, the cover portion 11 can also include a protrusion 19 (FIG. 4) configured to be flush with the outer surface of the upper shell wall 13*c* of the drawer wall 4, so that no steps or recesses are formed between the outer surface of the upper shell wall 13*c* and the cover portion 11.

Figure 3A:
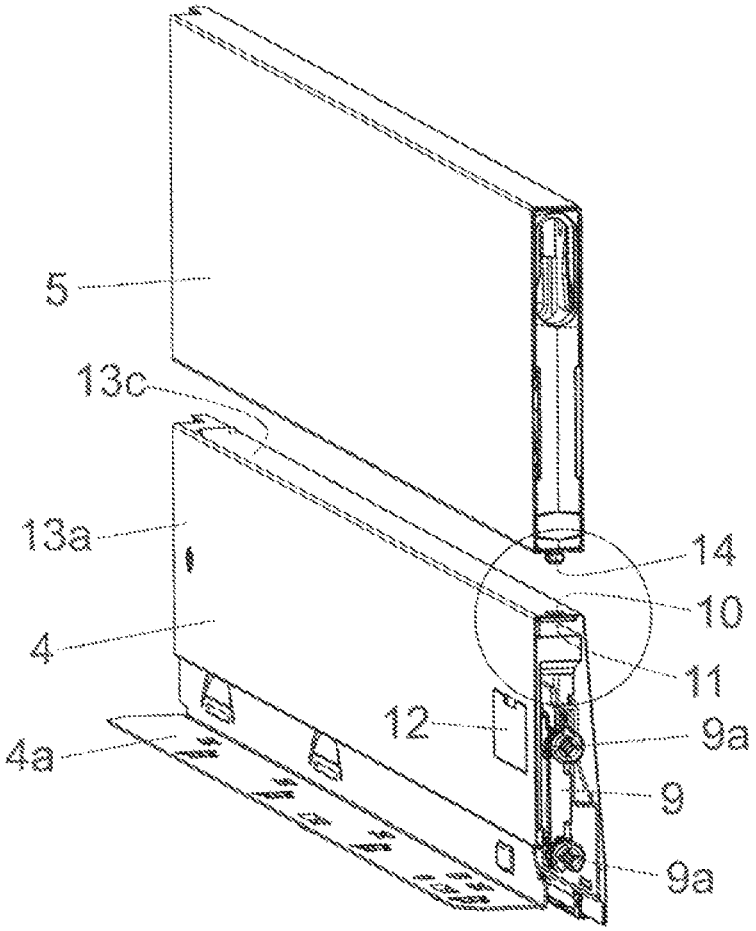
FIG. 3*a*-3*d* show the drawer wall with the wall element to be attached thereon in a perspective view from the front, and the introduction of a hook portion of the wall element into the opening of the drawer wall in temporal sequences.

FIG. 3*a* shows the drawer wall 4 with the wall element 5 to be set thereon in a perspective view from the front. In the shown embodiment, the opening 10 is arranged on a front-end region of the upper shell wall 13*c* of the drawer wall 4. However, the opening 10 may also be arranged on a rear end of the drawer wall 4 and/or on one of the two profiled (inner and outer) shell walls 13*a*, 13*b*. The wall element 5 includes a hook portion 14 configured to be introducible in the opening 10 of the drawer wall 4. The cover portion 11, upon introducing the hook portion 14 into the opening 10, can be moved against the resilient action of the spring element 18 from a closed position, in which the opening 10 is covered, into an open position, in which the opening 10 is unblocked. For the case in which the wall element 5 includes a massive decorative plate (for example made of glass), the hook portion 14 is to be arranged on an adaptor portion configured to be connectable to the decorative plate.

Figure 3B:
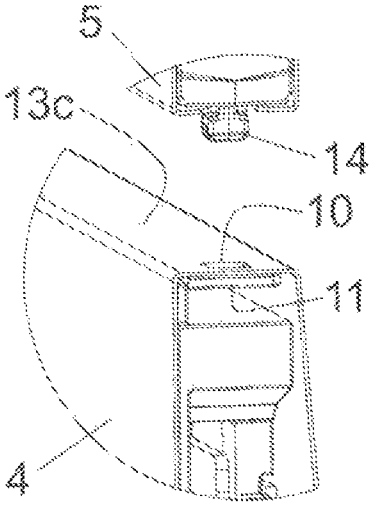
Figure 3C:
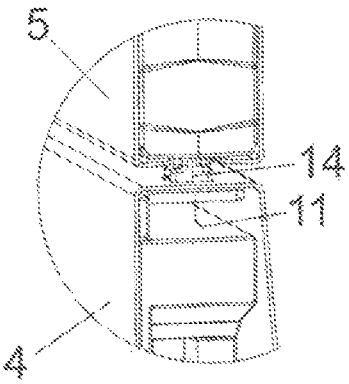
Figure 3D:
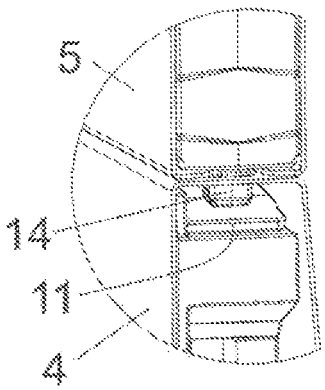

FIG. 3*b* shows the encircled region of FIG. 3*a* in an enlarged view, in which the hook portion 14 of the wall element 5 is visible, and the hook portion 14 is to be introduced into the opening 10. The cover portion 11 is thereby located in the closed position in which the opening 10 is covered. In FIG. 3*c*, the hook portion 14 contacts the cover portion 11. Upon a continued movement of the hook portion 14 in a downward direction, the hook portion 14 pushes the cover portion 11 against the resilient action of the spring element 18 in an open position in which the opening 10 is unblocked, as shown in FIG. 3*d*. Accordingly, the hook portion 14 of the wall element 5, in the mounted position, engages into the opening 10 of the drawer wall 4, so that a lateral and/or a vertical displacement of the wall element 5 relative to the drawer wall 4 is prevented or limited. The wall element 4 can also include a fastening device (not shown) for the hook portion 14, and the hook portion 14 can be fixed relative to the drawer wall 4 by the fastening device in a form-locking or in a force-locking manner. Upon removing the hook portion 14 from the opening 10, the cover portion 11 automatically snaps back into the closed position by the action of the spring element 18, and the opening 10 can be closed by the cover portion 11. Thus, it can be understood that an entirety of the cover portion 11 is located within the shell 13 of the drawer wall 4 (i.e, within a space defined by inner shell wall 13*a*, outer shell wall 13*b*, and upper shell wall 13*c*) in all operating positions of the cover portion 11. In this way, a neat aesthetic appearance is provided on the one hand, and the ingress of dirt into the interior of the drawer wall 4 can be prevented on the other hand.

FIG. 4 shows a carrier rail 15 of the drawer wall 4 in a perspective view, and the carrier rail 15 is connected, preferably welded, to the profiled shell walls 13*a*, 13*b* (FIG. 2*b*) in the mounted position. The carrier rail 15, in a cross-sectional view, includes a U-shaped profiled portion in which an extendable rail of a drawer pull-out guide can be arranged. The supporting limb 4*a* extending horizontally in the mounting position, together with the carrier rail 15, can have a one-piece configuration. In the front-end region of the carrier rail 15, a locking device 16 is provided for fastening the holding portion 9 to be mounted to the front panel 6. The holding portion 9 is configured to be automatically locked to the locking device 16 by the action of an energy storage member 17. A base body 20 is visible, and a spring element 18 for applying a force to the cover portion 11 in a direction of the closed position is configured to be bendable or tiltable about an axis (X) on the base body 20. The spring element 18 is movable in a direction approximately perpendicular the upper shell wall 13*c* of the drawer wall 4 in a direction of the arrow 21 against the operating direction of the spring element 18. The spring element 18 includes a base end portion on the base body 20 and a free end portion, and the cover portion 11 is formed by the free end portion of the spring element 18. Accordingly, in the shown embodiment, the cover portion 11, together with the spring element 18, has a one-piece configuration, and the spring element 18 is formed by a material elasticity of a plastic portion. The cover portion 11 can also include a protrusion 19 by which the opening 10 of the drawer wall 4 can be closed in a form-locking manner, so that the cover portion 11 is arranged flush with the surface of the upper shell wall 13*c* of the drawer wall 4. In this way, an elegant closure of the opening 10 can be realized, without steps or recesses being formed between the upper shell wall 13*c* outer surface and the cover portion 11. Moreover, the base body 20 includes at least one abutment element 22 by which, in the shown figure, a movement of the cover portion 11 in an upward direction, i.e. in a direction opposite the depicted arrow 21, can be limited. In this way, the cover portion 11 adopts a defined end position in a rest position in which the cover portion 11 covers the opening 10 of the drawer side wall 4.

In contrast to the shown figures, the cover portion 11 may also include a displaceably supported cylindrical pin which is pre-stressed by a helical spring in a direction of the closed position. The cylindrical pin closes a circular-shaped opening 10 of the wall element 4 in the closed position, and is movably supported in a direction against the operating direction of the helical spring, for example in or along a guide.

The invention claimed is:

1. A drawer wall, comprising:

a shell having a shell surface, an opening arranged on the shell surface of the shell, a movably supported cover portion configured to cover the opening in a closed position and to unblock the opening in an open position, and a spring element to pre-stress the cover portion in an operating direction of the spring element toward the closed position, wherein the cover portion is arranged so as to be stationary in a direction parallel to the shell surface and is movably supported in a direction approximately perpendicular to the shell surface against the operating direction of the spring element, wherein an entirety of the cover portion is arranged within the shell in all operating positions.

2. The drawer wall according to claim 1, wherein the spring element is formed by a material elasticity of a plastic portion.

3. The drawer wall according to claim 1, wherein the cover portion and the spring element collectively have a one-piece configuration.

4. The drawer wall according to claim 1, wherein the spring element includes a base end portion supported on a base body so as to be tiltable or bendable about an axis, and the spring element includes a free end portion, wherein the cover portion is formed by the free end portion of the spring element.

5. The drawer wall according to claim 1, wherein the shell is formed by a bent metal profile.

6. The drawer wall according to claim 5, wherein the bent metal profile of the shell is an extruded metallic profile or a steel sheet.

7. The drawer wall according to claim 1, wherein the cover portion includes a protrusion configured to be flush with an outer surface of the shell of the drawer wall in the closed position of the cover portion.

8. The drawer wall according to claim 1, wherein the opening is arranged on an upper wall of the shell.

9. The drawer wall according to claim 1, wherein the opening is arranged on at least one end region of the shell.

10. The drawer wall according to claim 9, wherein the opening is arranged on a front end region of the shell.

11. An arrangement comprising:

the drawer wall according to claim 1, and a wall element to be set onto the drawer wall in the mounted position.

12. The arrangement according to claim 11, further comprising a hook portion on the wall element, wherein the hook portion is configured to engage the opening of the shell surface in the mounted position.

13. The arrangement according to claim 11, wherein the wall element is formed by a bent metal profile or by a decorative plate.

14. The arrangement according to claim 13, wherein the wall element is a decorative plate made of glass, wood, plastic, stone or ceramics.

15. A drawer comprising the arrangement according to claim 11.

16. The drawer wall according to claim 1, wherein the shell has an inner shell wall, an outer shell wall, and an upper shell wall connecting the inner shell wall and the outer shell wall, the entirety of the cover portion being located within a space defined by the inner shell wall, the outer shell wall, and the upper shell wall of the shell.

17. A drawer wall, comprising:

an opening arranged on a shell surface of the drawer wall, a movably supported cover portion configured to cover the opening in a closed position and to unblock the opening in an open position, and a spring element to pre-stress the cover portion in an operating direction of the spring element toward the closed position, wherein the cover portion is arranged so as to be stationary in a direction parallel to the shell surface and is movably supported in a direction approximately perpendicular to the shell surface against the operating direction of the spring element, wherein the cover portion is arranged within the drawer wall in all operating positions, and wherein the cover portion includes a protrusion configured to be flush with the shell surface of the drawer wall in the closed position of the cover portion.

18. An arrangement comprising:

a drawer wall including:

an opening arranged on a shell surface of the drawer wall, a movably supported cover portion configured to cover the opening in a closed position and to unblock the opening in an open position, and a spring element to pre-stress the cover portion in an operating direction of the spring element toward the closed position, wherein the cover portion is arranged so as to be stationary in a direction parallel to the shell surface and is movably supported in a direction approximately perpendicular to the shell surface against the operating direction of the spring element, wherein the cover portion is arranged within the drawer wall in all operating positions, a wall element to be set onto the drawer wall in the mounted position; and a hook portion on the wall element, the hook portion being configured to engage the opening of the drawer wall in the mounted position.

* * * * *